United States Patent [19]

Gelsing et al.

[11] 4,217,097

[45] Aug. 12, 1980

[54] VENTURI-TYPE WORKPIECE-SUPPORT NOZZLE

[75] Inventors: Winfried Gelsing, Essen; Hans-Martin Nolzen, Voerde-Spellen, both of Fed. Rep. of Germany

[73] Assignee: Oschatz GmbH, Essen, Fed. Rep. of Germany

[21] Appl. No.: 27,859

[22] Filed: Apr. 6, 1979

[30] Foreign Application Priority Data

Apr. 8, 1978 [DE] Fed. Rep. of Germany ..... 2815323

[51] Int. Cl.[2] ..... F27D 3/02

[52] U.S. Cl. ..... 432/234; 432/235

[58] Field of Search ..... 432/234, 235, 233, 173; 137/599; 138/39; 165/142; 198/599

[56] References Cited

U.S. PATENT DOCUMENTS 3,471,134 10/1969 Cone ..... 432/74

FOREIGN PATENT DOCUMENTS 2615431 11/1977 Fed. Rep. of Germany .

*Primary Examiner*—Henry C. Yuen

*Attorney, Agent, or Firm*—Karl F. Ross

[57] ABSTRACT

A furnace workpiece-support system has at least one horizontal workpiece-support tube through which a fluid coolant is circulated and at least one vertical support post or tube connected at its upper end at a joint to the horizontal tube and having a blind lower end. A tubular pressure-alteration body is provided in this joint and has an intake mouth directed upstream and an outlet mouth directed downstream and of different flow cross section from the intake mouth. A flow diversion element, either a flat plate or a pipe, extends downwardly from the pressure-alteration body into the vertical tube to conduct into this tube fluid coolant diverted at the pressure-alteration body.

10 Claims, 6 Drawing Figures

VENTURI-TYPE WORKPIECE-SUPPORT NOZZLE

FIELD OF THE INVENTION

The present invention relates to an internally cooled workpiece-support grate. More particularly this invention concerns such a grate or support system used in an industrial pusher-type or tunnel-type furnace.

BACKGROUND OF THE INVENTION

It is known, as for example for U.S. Pat. No. 3,471,134 or German patent publication No. 2,615,431, to support a workpiece in a furnace on internally cooled support tubes. Two sets of such tubes are frequently provided to form a walking-beam conveyor.

In order to prevent the supports from heating excessively, they are formed entirely as tubes through which a fluid coolant such as air or steam is circulated. Normally this circulation takes place from one end to the other of the horizontal tubes. These tubes are in turn supported on vertical posts that must also be cooled. Thus these posts also are formed as tubes. Since considerable thermal expansion takes place in these arrangements it is normally necessary to close off the lower ends of the vertical support tubes and support them on carriages or the like that allow them to travel limitedly in the longitudinal direction in which the horizontal tubes expand.

Cooling of these vertical support tubes as well as the horizontal tubes is effected by means of a small-diameter diversion pipe that is provided at the joint between the upper end of each of the vertical tubes and the respective horizontal tube. Such a diversion pipe has an upper leg opening in the upstream direction, that is against the direction of flow through the horizontal tube, and a lower leg open downwardly into the center of the respective vertical tube. This lower leg is received with all-around clearance in the vertical tube. Thus some of the fluid coolant moving along the horizontal tube will enter the intake end of the diversion tube and will be injected from the output end thereof into the vertical tube. This diverted coolant cools the vertical tube and then rises in the annular space around the diversion pipe to rejoin the stream flowing along the horizontal tube. Such an arrangement ensures thar the same coolant stream will flow at least partially through the vertical support legs so as to prevent them from being excessively heated and, hence, weakened.

A disadvantage of this type of arrangement is that considerable turbulence is created at the joint where the upper end of each of the vertical tubes is connected to the respective horizontal tube. This turbulence is caused in part by drawing-off some of the flow from the horizontal tube, and in part by readmitting fluid into the horizontal tube. As a result of this turbulence the flow rate through the system and, with it, the overall cooling efficiency are reduced considerably.

OBJECTS OF THE INVENTION

It is therefore an object of the present invention to provide an improved internally cooled workpiece-support system.

Another object is to provide such a system wherein turbulence at the joint between the upper end of each of the vertical tubes and the horizontal tubes is minimized and wherein the vertical tubes are efficiently cooled.

SUMMARY OF THE INVENTION

These objects are attained according to the instant invention in a furnace workpiece-support system of the above-described general type and additionally comprising a tubular pressure-alteration body in each joint between each of the vertical tubes and the respective horizontal tube. Each such tubular pressure-alteration body has an intake mouth directed upstream and an outlet mouth directed downstream and of different flow cross section from the intake mouth. A flow-diversion element extends downwardly from the pressure-alteration body into the vertical tube so as to shut off a portion of the coolant for cooling of this vertical tube.

Thus according to the present invention the pressure at the joint between each of the vertical tubes and the respective horizontal tube is altered in such a manner that it is possible to divert a portion of the flow, inject it down into the vertical tube, and then readmit it to the flow with virtually no turbulence. The use of this relatively simple structure at each of the joints therefore ensures considerably increased cooling capacity.

According to a feature of this invention the body is constituted as a body of revolution centered on the axis of the horizontal tube and received with all-around spacing therein immediately above the upper end of the vertical tube. In one arrangement the body is of identical frustoconical inner and outer shape, tapering in the downstream direction so that its outlet mouth is substantially smaller than its intake mounth. The flow-diverting body may be a short vertical pipe opening at its upper end into the interior of this frustoconical body and having a lower end extending down into and opening downwardly in the vertical tube, or may be a vertical plate extending downwardly from underneath the pressure-altering body into the upper end of the vertical support tube.

It is also possible according to this invention to form the body Venturi-fashion. Thus the body has a cylindrical outer surface spaced radially inwardly from the cylindrical inner surface of the horizontal tube and an inner surface that is frustoconical and flares in the direction of flow, so that the outlet mouth is substantially larger than the intake mouth. In accordance with this invention the pressure-altering body is hollow, forming between its inner and outer walls an annular space decreasing in cross-sectional size in the direction of flow. The flow-diverting body is a vertical pipe having its upper end connected to the body and its lower end extending downwardly into and opening downwardly into the vertical tube. This pipe is in communication with the hollow interior of the body, and the body is formed at its leading or upstream edge with an array of axially open and angularly equispaced holes. Thus as pressure builds up at the leading edge of this body, coolant will enter it via these holes to flow downwardly in the pipe and function in the manner described above.

SPECIFIC DESCRIPTION

Figure 1:
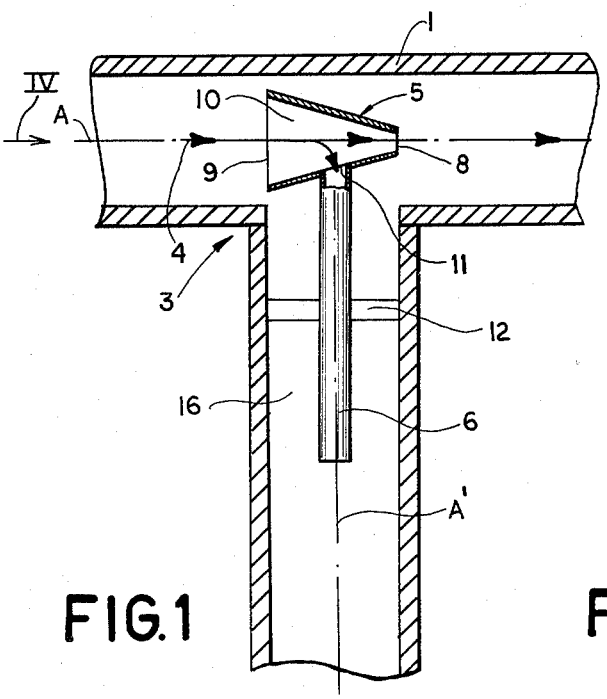
FIGS. 1, 2, and 3 are vertical sections through systems according to this invention.
Figure 4:
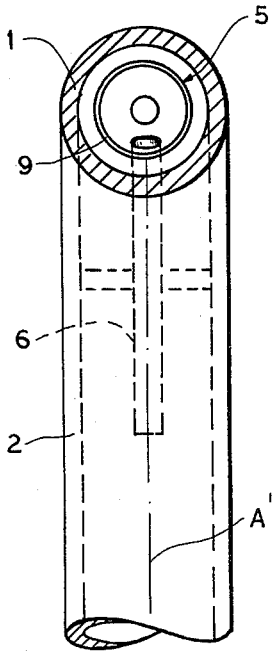
FIGS. 4, 5 and 6 are views taken respectively in the direction of arrows IV, V, and VI of FIGS. 1, 2, and 3.

As shown in FIGS. 1 and 4 a support system according to this invention has a horizontal tube 1 supported on a vertical tube 2 at a joint 3 and corresponding generally to that portion of a workpiece-support system such as shown in FIG. 8 of the above-cited U.S. Pat. No. 3,471,134 of CONE, the entire disclosure of which is herewith incorporated by reference. A fluid coolant, normally steam, is circulated through the horizontal tube 1 in horizontal direction 4 along its axis A. In order to cool the support tube or post 2 a pressure-alteration body 5 is provided at the joint 3 and has a vertically downward extending flow-diversion element 6. The body 5 is secured at 11 to the upper end of the element 6 which in turn is secured by means of radially extending struts 12 inside the upper end of the tube or post 2.

According to this invention the body 5 is of uniform wall thickness and of frustoconical shape, and is centered on the axis A. It has a relatively narrow outlet mouth 8 and a relatively large intake mouth 9. Thus as the fluid coolant enters the interior 10 of the body 5 it will be compressed somewhat, thereby increasing its pressure so as to force a portion of it into the upper end of the tube 6. This portion will therefore be forced downwardly from the lower end of the pipe 6 into the center of the tube 2 on the axis A' thereof. After having cooled the walls of the tube 2 the coolant will rise inside the tube 2 in the annular space 16 surrounding the pipe 6, and will rejoin the stream flowing horizontally in the direction 4 in the tube 1. Since the outer wall also of the body 5 tapers in the direction 4 of flow, a low-pressure zone will be created immediately behind the upstream edge of the body 5 so as to suck the fluid out of the space 16. Finally the high-pressure fluid exiting from the outlet mouth 8 will have a jet-pump effect and will ensure that, even though a good portion of the fluid is diverted down into and circulated inside the tube 2, little turbulence will be created at the joint 3.

Figure 2:
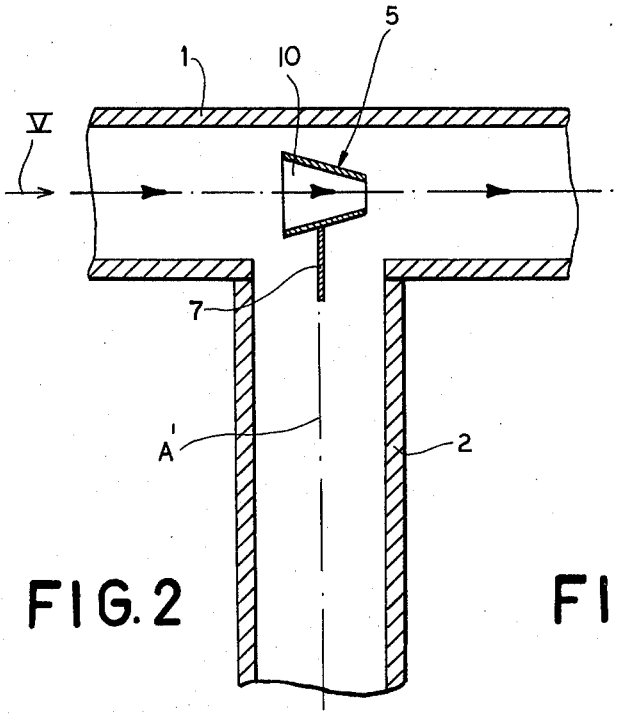
Figure 5:
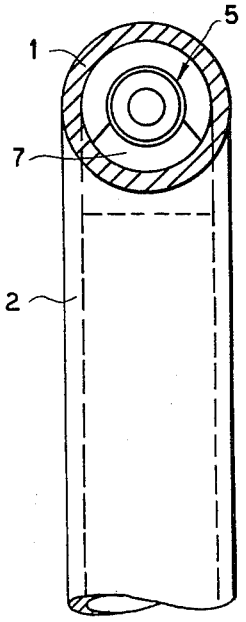

The arrangement of FIGS. 2 and 5 is substantially identical to that of FIG. 1, except that the tubular flow-diversion body is replaced by a flat plate 7 lying on a diameter of the axis A' and having a lower edge lying perpendicular to this axis A' within the tube 2. The upper part of the plate 7 substantially blocks flow through the tube 2 underneath the frustoconical body 5, so that considerable fluid is diverted down into the upstream side of the conduit 2. Otherwise this arrangement functions substantially identically to the arrangements of FIGS. 1 and 4.

Figure 3:
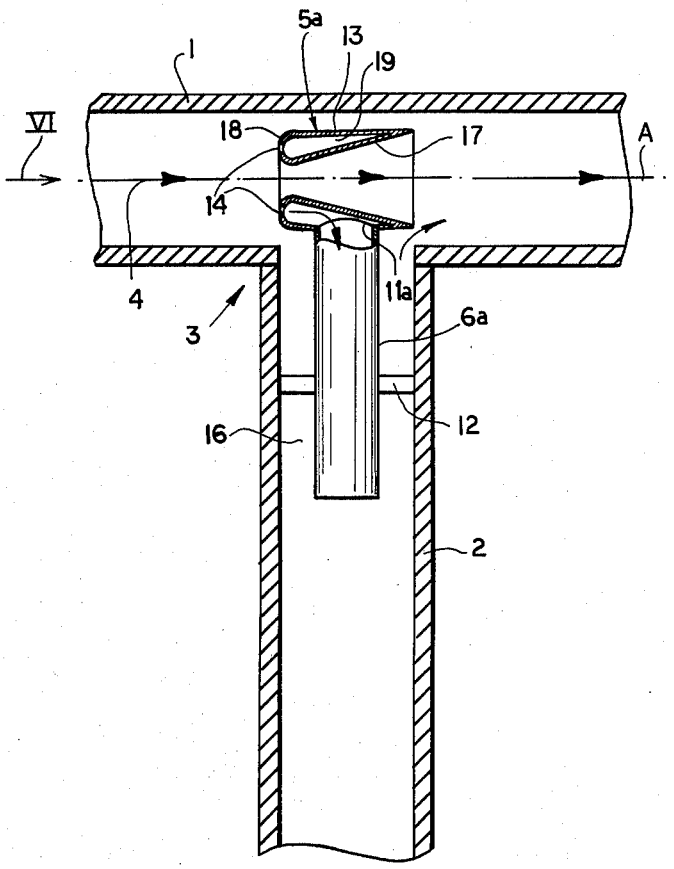
Figure 6:
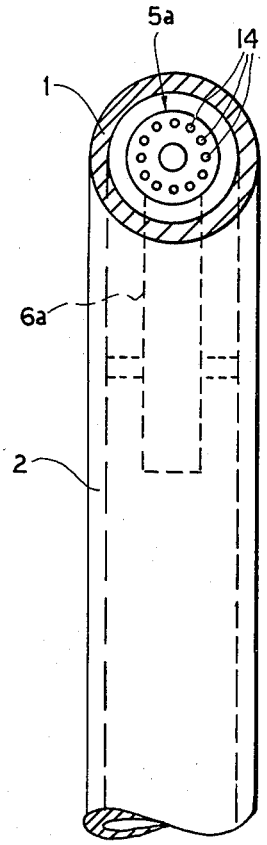

The arrangement of FIGS. 3 and 6 employs a Venturi-shaped body 5*a* has a cylindrical outer wall 13, a frustoconical inner wall 17 and a rounded leading edge 18. The walls 13 and 17 form a hollow interior 19 that is open axially through an array of twelve angularly equispaced holes 14 facing directly axially against the direction 4 at the front edge 18.

This arrangement has a tubular flow-diverting body 6*a* constituted as a pipe and connected at its upper end 11*a* to the wall 13, and opening into the hollow interior 19. Thus the high-pressure zone created at the leading edge 18 of the body 5*a* will be largely relieved by flow into the interior 19 through the holes 14. This portion of the flow will then be diverted down into the pipe 6*a* to be injected axially and centrally into the tube 2 in the same manner as the arrangement of FIGS. 1 and 4. Meanwhile flow around the cylindrical outer surface 13 of the body 5*a* will be substantially without turbulence. Flow axially through these frustoconically flared inner passages formed by the wall 13 will cause a low-pressure zone at the trailing end of the body 5*a* so as to aid in the sucking-out of the fluid in this space 16 between the pipe 6*a* and the tube 2.

In all of the arrangements the entire flow-diverting and pressure-altering device is mounted on the upper end of the tube 2 and lies within a vertical projection of the inner wall of the tube 2, so as to aid assembly of such a unit. The provision of these devices at each joint 3 greatly increases cooling efficiency at a modest initial construction cost.

We claim:

1. In a furnace workpiece-support system having at least one horizontal workpiece-support tube through which a fluid coolant is circulated and at least one vertical tube connected at its upper end at a joint to said horizontal tube and having a blind lower end, the improvement comprising:

a tubular pressure-alteration body in said joint and having an intake mouth directed upstream and an outlet mouth directed downstream and of different flow cross section from said intake mouth; and a flow-diversion element extending downwardly from said pressure-alteration body into said vertical tube.

2. The improvement defined in claim 1 wherein said outlet mouth is smaller than said intake mouth.

3. The improvement defined in claim 1 wherein said horizontal tube is centered on an axis, said body being a body of revolution also centered on said axis.

4. The improvement defined in claim 3 wherein said body is generally formed as a Venturi nozzle having a generally cylindrical outer surface and a frustoconical inner surface flaring in the direction of flow through said horizontal tube.

5. The improvement defined in claim 4 wherein said body is generally hollow between its said inner and outer surfaces and is formed with at least one forwardly opening aperture opening into its hollow interior, said flow-diversion element being a pipe having an upper end connected to said body and opening into said interior and a lower end extending down into and opening downwardly in said vertical tube.

6. The improvement defined in claim 5, further comprising struts supporting said pipe and therethrough said body in said vertical pipe.

7. The improvement defined in claim 6 wherein said body lies wholly within an upward projection on a horizontal plane of the inner surface of said vertical tube.

8. The improvement defined in claim 3 wherein said body has coaxial inner and outer substantially frustoconical surfaces tapering in the direction of flow through said horizontal tube.

9. The improvement defined in claim 8 wherein said flow-diversion element is a flat plate extending downwardly from said body into said vertical tube and substantially blocking the flow cross section of said horizontal tube below said body.

10. The improvement defined in claim 8 wherein said flow-diversion element is a vertical pipe having an upper end connected to and opening into said body and a lower end extending down in and opening downwardly into said vertical tube.

* * * * *